United States Patent [19]

Thompson

[11] Patent Number: 4,800,969

[45] Date of Patent: Jan. 31, 1989

[54] FAST DESCENT CORE BARREL APPARATUS

[75] Inventor: Terrence L. Thompson, Minneapolis, Minn.

[73] Assignee: Longyear Company, Salt Lake City, Utah

[21] Appl. No.: 125,016

[22] Filed: Nov. 24, 1987

[51] Int. Cl.[4] ..... E21B 25/02

[52] U.S. Cl. ..... 175/246; 175/236

[58] Field of Search ..... 175/246, 247, 249, 257, 175/236, 239

[56] References Cited

U.S. PATENT DOCUMENTS

| | | | |
|---|---|---|---|
| 3,004,614 | 10/1961 | Janson et al. | 175/246 |
| 3,103,981 | 9/1963 | Harper | 175/246 |
| 3,120,283 | 2/1964 | Braun | 175/246 |
| 3,266,835 | 8/1966 | Hall et al. | 294/86.24 |
| 3,305,033 | 2/1967 | Pickard et al. | 175/246 |
| 3,340,939 | 9/1967 | Lindelof | 175/246 |
| 3,485,310 | 12/1969 | Milosevich | 175/246 |
| 3,667,558 | 6/1972 | Lambot | 175/246 |
| 3,955,633 | 5/1976 | Bowles | 175/258 |

OTHER PUBLICATIONS

Huddy Inc.-Price List-Shurlock System.

*Primary Examiner*—Jerome W. Massie, IV
*Assistant Examiner*—Terry Lee Melius
*Attorney, Agent, or Firm*—Clayton R. Johnson

[57] ABSTRACT

A wire line core barrel inner tube assembly having a latch body that has a maximum diameter, axial intermediate portion providing a downwardly facing annular shoulder seatable on a drill stem landing ring and a fluid bypass channel extending through the maximum diameter portion and a valving assembly mounted by and cooperating with the latch body for controlling fluid flow through said channel. The valving assembly is operable to a position blocking the bypass channel but permits the inner tube assembly to move down faster than the fluid flow in the drill stem during the time the inner tube assembly moves downwardly in the drill stem. The bypass channel is blocked when the inner tube assembly is seated at the bit end of the drill stem until such time the pressure at the bypass upper port decreases below a preselected value above that at the lower port and thereafer decreased to permit the valving assembly being resiliently moved to open said channel and retain the channel open even though the pressure at the drill stem outer end is increased to that used during the core drilling operation.

15 Claims, 2 Drawing Sheets

FAST DESCENT CORE BARREL APPARATUS

BACKGROUND OF THE INVENTION

A wire line core barrel inner tube assembly having a downwardly facing annular suspension shoulder seatable on a core barrel outer tube landing shoulder, a bypass channel having an upper port above the annular shoulder, a lower port below the annular shoulder, and an axial bore extending between the ports and a ball movable in the bore between a position blocking fluid flow in the bore between the ports and a position permitting such flow through the ports.

It is known to provide an axial bore in a latch body upper section, an axially elongated bore, outer ports opening through the outer circumferential peripheral surface above the maximum diameter part of the latch body and to the bore, inner ports opening through the latch body outer circumferential peripheral surface below the maximum diameter part and the downwardly facing annular shoulder of the latch body, a piston mounted in the bore and resiliently urged upwardly, and a chevron shaped slot in the latch body for receiving a guide member that is joined to the piston. When the guide member is in the upper part of the inclined slot leg, the piston blocks fluid flow through the bore and when in the uppermost part of the vertical leg of the chevron slot the piston permits flow the bore, the piston being movable under fluid pressure from the upper part of the inclined slot leg to the intersection of the slot legs and when the pumping of fluid into the drill, stem stops, the guide member moves to its uppermost position in the vertical leg. However when the guide member is in the uppermost part of the inclined leg and the core barrel inner tube assembly is allowed to free fall under gravity in the drill stem, the rate of descent is very slow as the bypass channel is substantially blocked.

In the prior art, for example see U.S. Pat. No. 3,103,981 to Harper, when the lower port of the bypass channel is at the level of the minimum diameter portion of the hanger coupling (drill stem support shoulder) the fluid pressure at the pumping station increases and than drops as the port passes the minimum diameter portion. At times the operator may not notice the increase of pressure which signals the inner tube assembly is at the bit end of the drill stem. Even if a pressure gauge is provided at the pumping station which is of a type that has a needle which constantly moves with variations in pressure, and a second needle that is moved by the first needle and remains at the highest pressure position, the second needle may be broken off, or there may be significant variations in pressure as the inner tube assembly is pumped down the drill stem and if the operator is not constantly watching the gauage, the operator may not know whether or not the second needle position is a result of the inner tube assembly being moved to be seated on the hanger coupling portion.

In order to overcome problems such as the above as well as others, and to provide a fast descent wire line core barrel inner tube assembly, this invention has been made.

SUMMARY OF THE INVENTION

A wire line core barrel inner tube assembly that includes a latch body having an axially intermediate, maximum diameter first portion that is of a diameter larger than the diameter of any other part of the assembly, a second diametric portion joined to the first portion to form an axially inwardly facing suspension shoulder, an axially elongated bore, a first port opening to the bore and axially outwardly of the first portion, and a second port opening to the bore and axially inwardly of the first portion, the ports and at least part of the bore forming a fluid bypass channel, valving mechanism mounted in the bore for movement relative to the latch body between a first position for retaining the fluid channel in an open condition, a second position for blocking fluid flow through the channel when the assembly is being pumped downwardly in a drill stem and does not move downwardly faster than the column of fluid in the drill stem, but permits the channel opening to allow the assembly to move downwardly in the drill stem faster than the column of fluid, and a third position to control fluid flow through the channel in the same manner as set forth relative to the second position, and a spring for resiliently urging the valving mechanism and retaining the valving mechanism in one of the first and second positions, the latch body and valving mechanism having part cooperatively acting to maintain the valving mechanism in its second position. Upon increasing the fluid pressure at the first port a preselected value above that at the second port, the valving mechanism is forced from its second position and thereafter upon the fluid pressure at the first port decreasing below said preselected value from that at the second port, permitting the valve mechanism being resiliently moved to and thence resiliently retained in its first position.

One of the objects of this invention is to provide new and novel means in a core barrel inner tube assembly for controlling fluid flow through a fluid bypass channel. In furtherance of the above object, it is another object of the invention to provide such means that permits fast descent of the assembly in the drill stem, blocks any significant fluid bypass once the assembly is seated at the bit end of the drill stem, and continues to block such bypass until the fluid pressure at the fluid channel outer port exceeds that at the channel inner port by a preselected value and unblocks said channel upon the pressure at the outer port relative to the inner port decreasing below said preselected value.

Another object of this invention is to provide new and novel means in a wire line core barrel inner tube assembly that provides an open fluid channel to permit fast descent in a drill stem, but blocks the channel after the assembly is seated at the drill bit end of the drill stem, and then maintains the channel blocked until the pressure of fluid being pumped being decreased, and upon being decreased so that the pressure at the fluid channel outer port is less than a preselected value above that at the fluid channel inner port, opening the fluid channel and maintaining the fluid channel open even though the fluid pressure is subsequently increased above that what it was prior to the time that it was decreased.

For purposes of facilitating the description of the invention, the term "inner" refers to that portion of the drill stem, or of the assembly, or an element of the assembly being described which in its position "for use" in, or on, the drill stem is located closer to the drill bit on the drill stem (or bottom of the hole being drilled) than any other portion of the apparatus being described, except where the term clearly refers to a transverse circumferential, direction, or diameter of the drill stem or other apparatus being described. The term "outer" refers to that portion of the drill stem, or of the assembly, or an element being described which in its position of "for use" in or on the drill stem is located axially more remote from the bit on the drill stem than any other portion of the apparatus being described, except where the term clearly refers to a transverse circumferential, direction or diameter of the apparatus being described.

Figure 1:
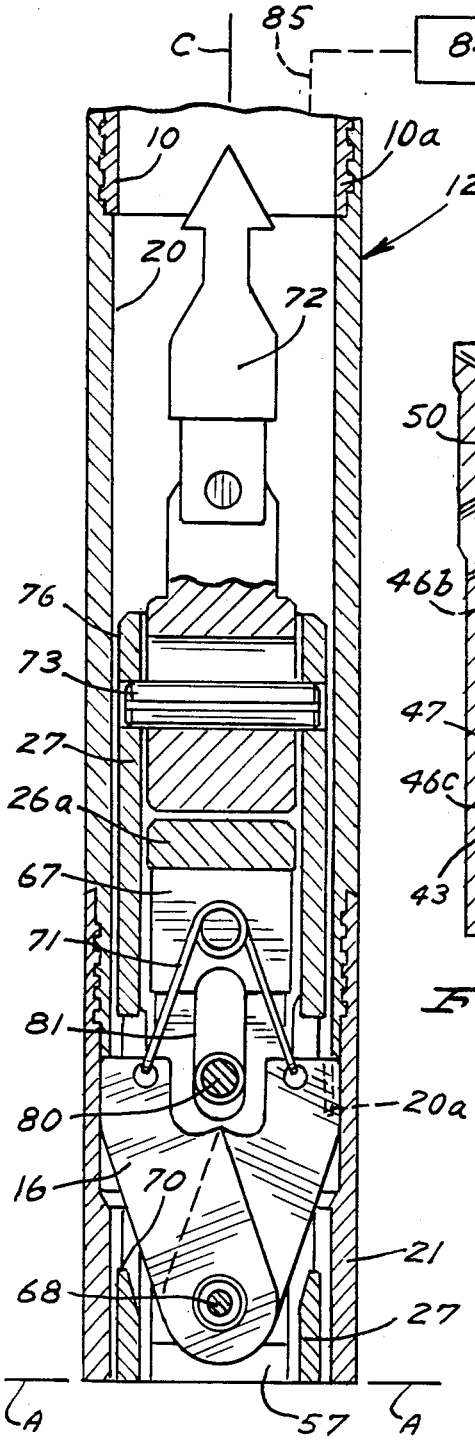
FIGS. 1 and 2 with FIG. 1 arranged above FIG. 2, the axial center lines aligned and lines A—A and B—B aligned, form a composite longitudinal section through the upper portion of the core barrel inner tube assembly of this invention in its latch seated, core drilling position with the fluid bypass channel open.
Figure 2:
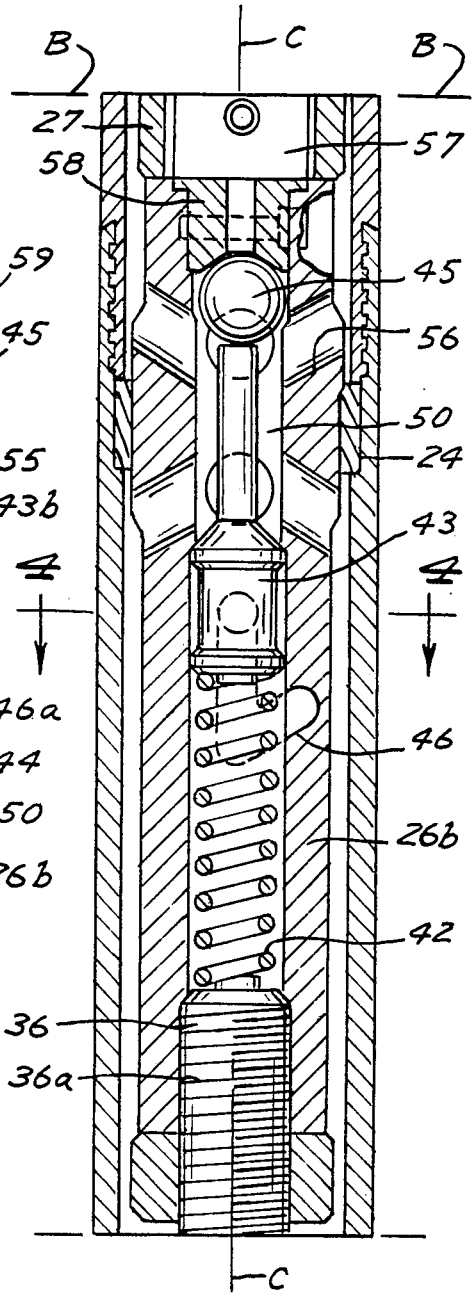
Figure 4:
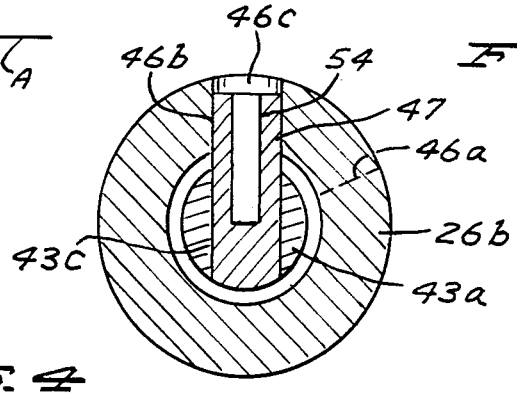
FIG. 4 is a transverse cross sectional view generally taken along the line and in the direction of the arrows 4—4 of FIG. 2.
Figure 3:
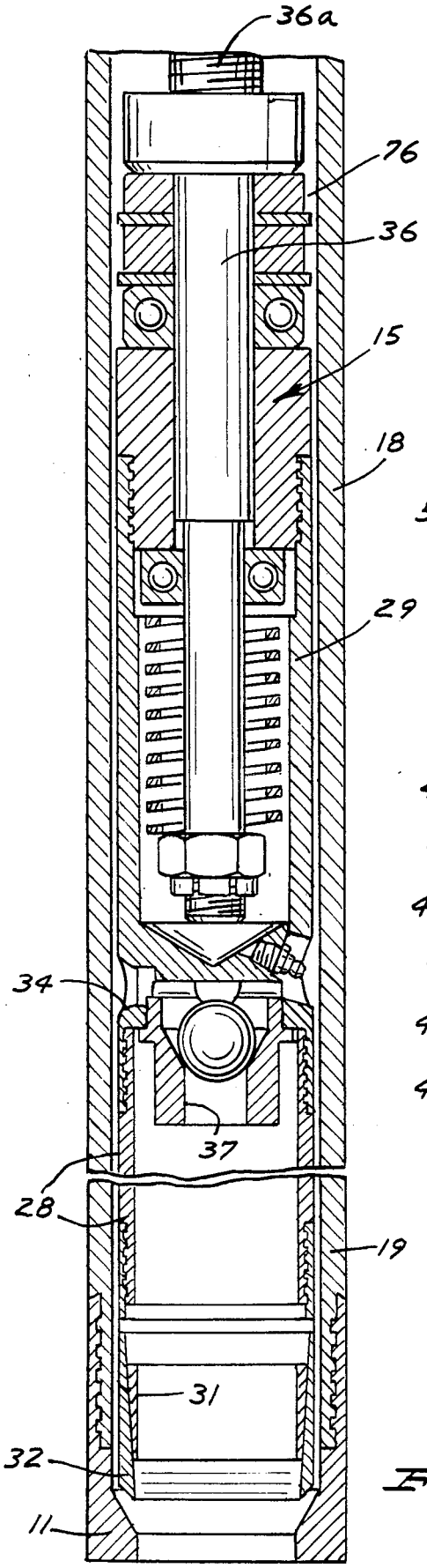
FIG. 3 is a view corresponding to that of FIGS. 1 and 2, other than it is of the lower part of the core barrel inner tube assembly and an axial intermediate part is broken away.

Referring now in particular to FIGS. 1–3, there is illustrated a hollow drill stem 10 which is made up of sections of pipe (drill rods) coupled together and having an annular drill bit 11 mounted on the inner end thereof, pump apparatus being indicated by block 84 for pumping fluid under pressure through line 85 into the outer end of the drill stem in a conventional manner.

The portion of the drill stem attached to or extending below pipe section 10*a* is commonly referred to as a core barrel outer tube assembly, generally designated 12; the core barrel outer tube assembly being provided for receiving and retaining the core barrel inner tube assembly 15. Details of the construction of the core barrel outer tube assembly of the general nature used in this invention may be such as that disclosed in U.S. Pat. Nos. 3,120,282 and 3,120,283. The core barrel outer tube assembly 12 is composed of a core barrel outer tube 18, a reaming shell 19 threadedly connected to the inner end of the tube 18 and an annular drill bit 11 for drilling into the earth formation from which the core sample is taken, said bit being threadedly connected to the inner end of the reaming shell. The outer end of the assembly 12 includes a locking coupling 20 which connects the assembly 12 to the adjacent pipe section 10*a* of the drill stem. At the opposite end of the coupling 20 from the above mentioned pipe section, an adaptor coupling 21 is connected. The lower end of the locking coupling in conjunction with the annular recess 21*a* of the coupling 21 form a seat inside of the surface of the adaptor coupling against which the latches (detent members) 16 of the core barrel inner tube assembly are seated for removably retaining the assembly 15 adjacent to the core bit. The lower end portion of the locking coupling may have a projection flange 20*a* which extends as a partial cylindrical surface more closely adjacent to the core bit than to the main part of said coupling. This flange bears against the face of a latch to cause the latches and other portions of the core barrel inner tube assembly to rotate with the drill stem when the latches are in a latched position such as indicated in FIG. 1.

Threadedly connected to the inner end of the adaptor coupling is the core barrel outer tube, it being understood that a hanger coupling (not shown) could be interposed between the adaptor coupling and the outer tube and in which case the outer tube would be of a shorter length. The core barrel outer tube where it is threadedly to the core barrel outer tube is provided with an annular recess 24 for mounting a landing ring 25.

The core barrel inner tube assembly 15 includes a latch body assembly made up of an outer (upper) latch body portion 26*a* that at its lower end is threadedly connected to the latch body bottom (inner) portion 26*b*, and has latches 16 mounted thereon, a latch release tube 27 for retracting said latches, a core receiving tube 28, an inner tube cap 29 threaded into the outer end of the core receiving tube, and a spindle and bearing subassembly 36 for connecting the cap to the inner portion of the latch body assembly for limited slidable movement relative to said cap. The core receiving tube has a replaceable core lifter case 31 and a core lifter 32. The structure and function of the core lifter case and core lifter may be of the general nature set forth in U.S. Pat. No. 2,829,868 and therefore will not be described.

A fluid passageway 34 is formed in the cap 29 at one end to open through a valve subassembly 37 to the interior of the upper end of the core receiving tube and at the opposite end to open to the annular clearance space between the core barrel inner tube assembly and the core barrel outer tube 18 that forms a part of the annular fluid channel 76 to permit fluid to bypass the core barrel inner tube assembly when in a core taking position such as illustrated in FIGS. 1–3.

The cap 29 is mounted by the spindle-bearing subassembly 36, the subassembly 36 and the manner of the mounting thereof being very similar to that described in greater detail in U.S. Pat. No. 3,305,033.

A plurality of circumferentially spaced, transverse and inwardly inclined ports 56 are provided in the latch body inner portion to at one end open through the maximum diameter portion 62 of the latch body to the fluid channel 76 between the core barrel inner tube assembly and the drill stem, and at the opposite ends to open into an axial intermediate portion 50*a* of the axial bore 50. A second plurality of ports 55, which are oppositely transverse inwardly inclined are formed in the latch body bottom portion to at one ends open through the latch body intermediate diameter portion 60, 61 axially inwardly of frusto-conical suspension shoulder 59 and at the opposite end open to the axially intermediate portion 50*a* of the bore 50 a substantial distance axially inwardly of the opening of the outer ports 56 to the bore 50. The lower ports 56, the intermediate portion 50*a* of the bore 50, and the ports 55 provide a fluid bypass channel to bypass the shoulder 59 and the landing ring when the inner tube assembly is in its latch seated position and to permit fast descent as will be described.

As may be noted from FIG. 2, the bore 50 opens through the inner axial end of the lower latch portion of the latch body and at the inner end is threaded for threadedly mounting the spindle 36*a* of the spindle-bearing subassembly. Located within the inner end of bore 50 is a coil spring 42 which has one end abutting against the spindle and an opposite end against the enlarged guiding surface portion 43*a* of the piston 43 of the fluid bypass flow control valving assembly, generally designated 44. The guiding portion 43*a* is in guiding relationship with the latch body wall portion defining the bore and in all of its operative positions is located axially inwardly of the opening of the ports 55 to bore 50. The piston includes an axial outer plunger portion 43*b* that is integrally joined through a frusto-conical portion to portion 43*a* and that throughout its axial length in transverse cross section is of a substantially smaller diameter than that of the bore 50. The axial length of the plunger portion 43*b* is greater than the minimum axial spacing of the openings of ports 55 to bore from the openings of ports 56 to bore 50.

The upper latch body portion has a lower threaded part 58 threaded into the upper threaded part of the lower latch body portion wall that defines the upper part 50*d* of bore 50. A radial slit (not shown) that opens to bore part 50*d*, the radial opposite circumferential part of the latch body and the top transverse edge of the lower latch body portion 26*a* form a split ring clamp portion into which a cap screw 64 is threaded to aid in retaining the lower threaded part 58 in bore portion 50*d* without extending radially outwardly of the diametric portion of the lower latch body part that it is threaded into. The threaded part 58 may have a small diameter axial hole 58*a* that opens to bore and to the slot 67 in which the latch body insert 57 is located. The hole 58*a* would be of a diameter and the insert block 57 would be mounted to permit only leakage flow through the hole. Located within the bore 50 axially between the axial outer end of the plunger portion 43*b* and the lower end of the latch body part 58 is a spherical ball (valving member) 45 which is part of the valving subassembly and is of a diameter only very slightly smaller than the minimum diameter bore portion 50*a* of the bore 50. Each of the ports 55, 56 opens to bore portion 50*a*. The inner transverse surface of part 58 is shaped and located sufficiently axially outwardly of the axially inwardmost part of the opening of the ports 56 to bore 50 when the ball abuts against part 58 fluid may flow radially inwardly in through ports 56 with these ports being sufficiently unblocked so as not to significantly restrict fluid flow through bore 50 to ports 55. When the ball abuts against part 58 and the piston plunger portion, the fluid bypass channel is fully open.

The bore 50 includes a bore portion 50*b* that is of a larger diameter than bore portion 50*a* to permit limited transverse movement of the ball in order that the ball may properly seat against the axial inner transverse surface of latch body part 58 whereby leakage flow through hole 58*a* is substantially blocked. The leakage flow and the bore portion 50*b* facilitates the movement of the ball 45 (prevents liquid being trapped between the ball and part 58). At this time, advantageously at least half of the ball is located outwardly of the outermost part of the opening of ports 56 to bore 50.

Formed in the latch body is a chevron slot 46 that extends radially to open to the bore 50 and through the outer peripheral surface of the latch body axially inwardly of ports 55 and axially outwardly of the spindle 36*a*. The slot 46 includes an axial (vertical) elongated leg 46*b* having a central axis of elongation parallel to the central axis C—C of the core barrel inner tube assembly and an inclined slot (helically cut) leg 46*a* that from the apex 46*c* of the slot (intersection of legs 46*a*, 46*b*) extends radially in an outward (upward) direction. The leg 46*a* is axially shorter than leg 46*b* and a its closed end (axial outer end) is axially intermediate the slot apex and the closed end (axial outer end) of the leg 46*a*.

Figure 5:
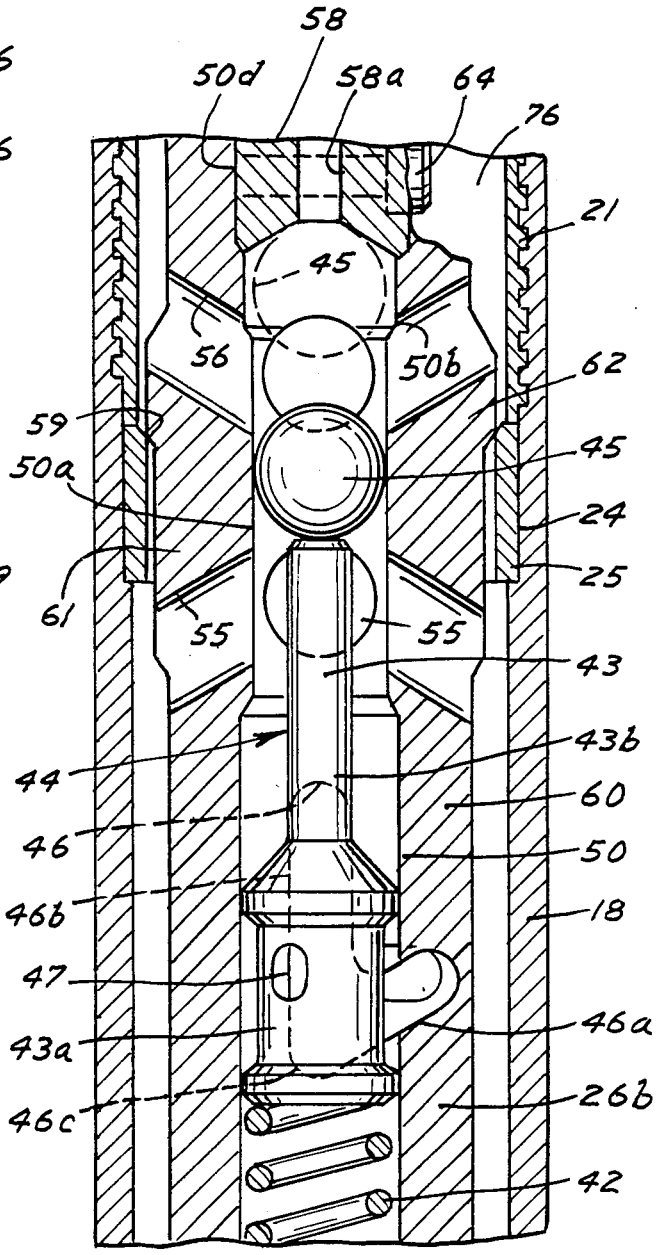
FIG. 5 an enlarged view of part of the structure shown in FIG. 2, except that the piston assembly is shown in its pump-in position, the dotted line showing of the valving assembly ball being that when the core barrel inner tube assembly is moving downwardly in the drill stem faster than any downward movement of the drilling fluid in the drill stem and the solid line showing of the ball being that of the fluid and core barrel inner tube assembly moving downwardly at the same rate and when the assembly is seated at the bit end of the drill stem prior to the fluid pressure acting on the valving assembly to move the valving assembly out of its pump-in position.

Extended within a transverse aperture 43*c* in piston portion 43*a* and threadedly or otherwise suitably secured to portion 43*a* is a transverse guide member 47 that extends radially (transversely) into slot 46 to be moved between a position abuttable against the closed end of the inclined leg 46*a* and a position in leg 46*b* closely adjacent to the closed end of leg 46*b*. However the guide member does not extend radially outwardly of the axially adjacent part of the latch body. The chevron slot is located and of dimensions such that when the piston plunger portion abuts against the ball and the ball abuts against part 58, the guide member is closely adjacent to or in abutting relationship to the latch body wall defining the closed end (upper end) of axial leg 46*b* while when the guide member abuts against the latch body wall defining the closed end of slot leg 46*a*, the outer end portion of the portion 43*b* is located axially inwardly of the opening of ports 56 to bore 50 by a dimension at least half that of the radius of the ball. Thus when the guide member abuts against the closed end of the inclined slot leg 46*a* the ball is movable axially inwardly relative to the latch body to a position that the ball blocks substantially all fluid flow from ports 56 and axially inwardly through bore 50 to ports 55. When the guide member abuts against the slot apex 46*c*, the ball is axially inwardly of the solid line pump-in position of FIG. 5, assuming that at this time the ball is abutting against the plunger portion, but still has its center above the axial outwardmost part of the opening of ports 55 to bore 50 so that any significant fluid flow from ports 56 to bore 50 and thence to ports 55 is blocked.

The coil spring 42 of the valving subassembly acts to resiliently move the piston to a position that the guide member abuts against the closed end of slot leg 46*a* (fast descent position if the inner tube assembly is moving downwardly at a faster rate than the movement of the drilling fluid in the drill stem, or the inner tube assembly is in its latch seated core taking position and fluid has not been applied under sufficient pressure to move the piston downwardly in the bore); or retain the piston and thereby the ball closely adjacent to part 58. In order to manually move the guide member from the closed end of one of the slot legs to the closed end of the other, the guide member is provided with a radial opening 54 into which one end of a hand tool (not shown) is extended whereby the guide member and thereby the piston moved axially inwardly to a position the guide member abuts against or is adjacent to the slot apex and the guide member is controlled and/or permitted to move axially outwardly in the slot leg other than the leg that it was in. That is the tool is of a shape that it may extend into the guide member opening and far enough radially away from the latch body that the tool may be manually moved to move the guide member as set forth in the preceeding sentence.

The latch body diametric portions 62 and 61 are of relative diameters to form the axially inwardly facing annular suspension shoulder 59 that is seatable on landing ring 25 to limit the axial inward movement of the core barrel inner tube assembly. When the suspension shoulder is seated on the landing ring, fluid flow between the landing ring and the inner tube assembly is substantially blocked. However, when thus seated the openings of ports 55, 56 through the latch body outer circumferential surface are located on axially opposite sides of the landing ring to provide an open fluid channel bypassing the landing ring, assuming the ball center is axially outwardly of the axially inwardmost part of the ports 56 such as shown in FIG. 2.

A rectangular slot 67 is formed in the latch body axial outer portion, there being a through pin 68 extended through said slot and appropriate apertures in the latch body top portion for pivotally mounting a pair of latchs 16 in side by side relationship. A latch release tube has a slot 70 radially opposite the outer half of each latch through which the respective latch can be extended to engage the latch seat 21*a*, there being provided a spring 71 to resiliently urge the respective latch to pivot about the through pin 68 and extend radially outwardly through the slots 70. A spear point overshot coupling member 72 is mounted by the outer end portion of the latch release tube 27 by a pin 73 for being couplingly engaged by an overshot assembly (not shown) for retracting the core barrel inner tube assembly. Even though the spear point 72 shown is of substantially the same construction as that described in U.S Pat. No. 4,281,725 and functions in the same manner, it is to be understood other types of overshot coupling members can be used. Further since the function of the locking pin 80 which is mounted by the latch release tube for movement therewith and is extended through slots 81 in the latch body are also described in U.S. Pat. No. 4,281,725, details of the construction and function thereof are not being set forth therein.

Figure 6:
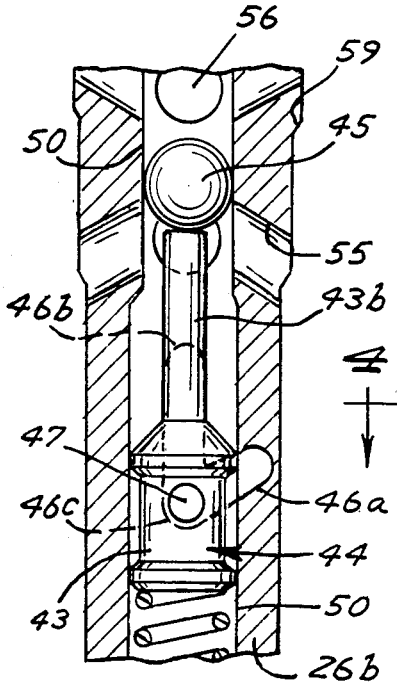
FIG. 6 is a view corresponding to that of FIG. 5 other than it shows the ball and piston in their innermost positions relative to the latch body.

In using the apparatus of this invention, first a tool is used to axially push the guide member and thereby the piston down from the position shown in FIG. Z to the position shown in FIG. 6 and then the tool is arcuately moved about the core barrel inner tube assembly central axis as the piston is allowed to be resiliently moved axially outwardly whereby the guide member is moved outwardly and angularly to the closed end of the chevron slot leg 46*a*. The tool may be a rod having one end portion of a diameter to form a relatively close fit with the guide member opening.

Now the core barrel inner tube assembly is inserted into the drill stem, and as drilling liquid is pumped into the drill stem, usually the assembly 15 drops faster than the rate of flow of liquid pumped into the drill stem. As a result liquid below the latch body flows into ports 55 and bore 50 to force the ball upwardly relative to the latch body to abut against the part 58 so that liquid can exit through ports 56 and to the fluid channel between the latch release tube and the drill stem. With reference thereto the usual clearance between the drill stem inner peripheral wall and outer peripheral surface of the latch body enlarged diametric portion 62 is relatively small (other than at the latch seat 21) and portion 62 is of a larger diameter than any other part of the core barrel inner tube assembly, if this bypass feature were not provided, the rate of descent of said assembly in the drill stem would be substantially slower. On the other hand if no provision were made for blocking the bypass channel when the core barrel inner tube assembly is seated on the landing ring, the increase of fluid pressure in the drill stem resulting as ports 55 passed the landing ring may not be noted and the operator would not know the inner tube assembly was in a position seated on the landing ring.

When the latch body shoulder seats on the landing ring the latches are resiliently moved into the latch seat and the downward movement of the inner tube assembly stops. Since there no longer is any flow of liquid into ports 55 and thence into bore 50 and liquid is still being pumped into the drill stem the ball moves downwardly to abut against the piston plunger (solid line position of FIG. 5) and thereby blocks any significant liquid flow through the bypass channel 50, 55, 56. This results in pressure in the drill stem building up sufficiently to push the piston subassembly downwardly until the guide member abuts against the apex of the chevron slot and the ball moves downwardly in the bore 50 to continue to permit, at most only a small amount of liquid bypassing through channel 50, 55, 56. That is fluid pressure acts on at least one of the ball and piston portion 43*a* to move the piston downwardly relative to the latch body. When the guide member abuts against the apex 43*c* the center of the ball is lower than that shown in FIG. 5 but is still above the uppermost part of the openings of lower ports 55 to bore 50, i.e. is in the position shown in FIG. 6. The high pressure signal at the surface is maintained until such time as liquid is no longer being pumped into the drill stem or the pump-in pressure is sufficiently decreased through action of the operator. After the pump-in pressure is suffiently decreased or the pumping in of liquid is stopped, the spring 42 moves the piston subassembly and therethrough moves the ball upwardly to abut against part 58. As the piston moves up, the guide member moves up in the chevron slot leg 46*b*, there being no turning force applied to the piston. The movement of the ball to abut against part 58 opens the fluid bypass channel, and then upon restarting the pumping in of fluid or increasing the pump-in pressure liquid flow through the bypass channel for core taking operation is started and the bypass channel remains open.

If the core barrel inner tube assembly is allowed to free fall (not pumped in) through a column of liquid with the guide member in slot leg 46*a* the fluid pressure in ports 55 over that in ports 56 will increase enough to result in the ball moving upwardly to allow fluid to pass through the bypass channel. After sufficient time has elapsed for the core barrel inner tube assembly to seat on the landing ring and has stopped falling the ball drops to the solid line FIG. 5 position. Now fluid under pressure is pumped into the drill stem to operate the valving assembly to its FIG. 6 position and thereafter stopped to allow the valving assembly to be spring moved to its bypass channel open position.

In the event that during the pump-in operation the core barrel inner tube assembly does not move downwardly sufficiently faster than the column of drilling fluid in the drill stem to move the ball off the piston plunger due to gravity, the ball remains in contact with the piston plunger. As a result the bypass channel is blocked and the pump-in pressurized drilling fluid acts in conjunction with the weight of the inner tube assembly to move the inner tube assembly and the column of drilling fluid below the inner tube assembly downwardly. When the inner tube assembly seats on the landing ring, the operation is as has been previously set forth except the ball already abuts against portion 43*b*.

With reference to the use of this invention and assuming no tool is being used, when the valving assembly is in its pump-in position (solid line position of FIG. 5) the fluid pressure at ports 56 must be of a sufficiently greater value than that at its ports 55 to overcome the resilient action of spring 42 whereby the guide member can be moved to the FIG. 6 position. This pressure differential can be varied by substituting one spring 42 for another having different spring characteristics. Assuming again that no tool is being used, when the valving assembly is in its FIG. 6 position, upon decreasing the fluid pressure in ports 56 below a preselected value above that in ports 55 (the amount depending upon the spring characteristics of spring 42) the valving assembly moves to its core drilling operating position of FIG. 2 to open the fluid bypass channel.

The latch body lower portion and the piston assembly can be substitued for the latch body lower portions of other core barrel inner tube assemblies, for example ones such as disclosed in U.S. Pat. No. 3,305,033. In such an event there may also be provided a coupling (not shown) that is threaded onto coupling 21 to mount the landing ring, and in turn mounts the core barrel outer tube, assuming the latch body lower portion of this invention is longer than the one that is to be replaced. The dimensions of bore portions **50*b* would be changed to accommodate the ball 45** and the threaded part of the latch body upper portion of the existing core barrel inner tube assembly that is to be threaded into the axial bore of the latch body lower portion of this invention and not permit liquid being trapped even though no leakaged hole is provided in said threaded part.

Any leakage flow downwardly through bore **58*a* would not be sufficiently great to move the ball 45 downwardly from the FIG. 2** position to significantly interfer with fluid flow through the bypass channel.

What is claimed is:

1. A wire line core barrel inner tube assembly that is pumpable downwardly in a drill stem, comprising an axially elongated latch body having an upper end portion and a lower end portion, a retractable latch member mounted by the latch body for movement between a latch seating position and a latch retracted position, latch release means mounted for limited movement relative to the latch body between a latch retracted position and a latch seated position, means for receiving a core sample connected to the latch body lower portion, the latch body having a radially outer peripheral surface, an axially intermediate first section of a larger diameter than any other part of the inner tube assembly, a second section axially below the first section and joined thereto to form a downwardly facing annular shoulder, and an axially elongated bore having an upper end portion that includes an upper end portion, an axial intermediate portion and a lower end portion, an upper port opening to the bore intermediate portion and through the latch body outer peripheral surface above the latch body first section, a lower port opening to the bore intermediate portion and through the latch body outer peripheral surface below the latch body shoulder, the lower port being axially inwardly of and axially spaced from the opening of the upper port to the bore, the ports and bore axially between the ports forming a fluid bypass channel, a valving member being mounted in the bore for movement between a lowered position at least substantially blocking flow of fluid through said fluid bypass channel and an upper position permitting fluid flow through the fluid bypass channel, a piston movable relative to the valving member and mounted in the bore for movement between a first axial position for retaining the valving member in the valving member upper position and a second axial position axially inwardly of the first position for permitting the valving member to move to its lowered position, and means for constantly resiliently urging the piston to move to its first position, said valving member being movable from the valving member lowered position toward the valving member upper position sufficiently to permit fluid flow through the fluid bypass channel by fluid flowing into the second port and thence to the bore when the piston is in its second position to permit fast descent of the assembly in the drill stem, the piston and latch body having cooperating means for releasably retaining the piston in the selected one of the piston positions and when the piston is in its second position, the valving member is in its lowered position and the fluid pressure in the upper port exceeds that in the lower port by a preselected amount, fluid pressure acting on at least one of the valving member and the piston moves the piston out of its second position so as to permit the piston thereafter moving the valving member to its upper position when the pressure difference between the upper and lower ports decrease by about the preselected amount.

2. The apparatus of claim 1 further characterized in that the cooperating means comprises a latch body wall defining a generally chevron shaped slot that opens to the bore and includes a generally axially extended first leg that has an upper end and a lower end and a second leg that has a lower end intersecting with the first leg below the upper end of the first leg and an upper end axially inwardly of the first leg upper end, the second leg extending angularly away from the first leg in an upward direction and a piston guide portion joined to the piston and extended into said slot for controlling the movement of the piston between its positions.

3. The apparatus of claim 2 further characterized in that the latch body has means for limiting the upward movement of the valving member to a position that the valving member is at least in part located above the opening of the upper port to the bore.

4. The apparatus of claim 2 further characterized in that the piston includes a lower main body portion in abutting relationship to the resilient means and forming a relatively close fit with the bore wall and an upper portion having a lower end joined to the main body portion and of a transverse diameter substantially smaller than that of the bore.

5. The apparatus of claim 4 further characterized in that the length of the piston upper portion is greater than the minimum axial spacing of the opening of the ports to the bore, the valving member being in abuttable relationship to the piston upper portion.

6. The apparatus of claim 4 further characterized in that the valving member comprises a spherical ball that is movable by fluid flowing in through the second port to the bore to permit substantial fluid flow through the channel when the piston is in its second position.

7. The apparatus of claim 1 further characterized in that the cooperating means includes a latch body wall portion defining a slot for limiting the movement of the piston and having a vertical leg that has an upper end portion and a lower end portion and an inclined leg that has a lower end portion opening to the vertical leg lower end portion and an upper end portion that is circumferentially offset and vertically intermediate the vertical leg portions, and a piston guide member extended into the slot, the piston in its first axial position having the guide member located adjacent to the vertical slot upper end portion and in its second axial position in the upper end portion of the inclined leg.

8. A wire line core barrel inner tube assembly that at least in part is pumpable through a downwardly extending drill stem by liquid under pressure for being seated adjacent to bit end of the drill stem, comprising an axially elongated latch body having a radially outer peripheral surface, a first axially intermediate portion of a larger diameter than any other part of the assembly, a second portion of a smaller diameter than the first portion and axially inwardly of the first portion, and a fluid bypass channel that includes a first port that at least in part opens through the outer peripheral surface axially outwardly of the first portion and a second port that at least in part opens through the outer peripheral surface inwardly of the first portion, valving means mounted for movement relative to the latch body for permitting bypass liquid flow through the fluid bypass channel and alternately blocking any significant liquid flow through said fluid bypass channel, said latch body and valving means having cooperating means for permitting substantial liquid flow through the fluid bypass channel when liquid is being pumped downwardly in the drill stem to allow the assembly to move downwardly in the drill stem at a faster rate than the downward movement of liquid in the drill stem and to block said fluid bypass channel when said assembly is seated at the bit end of the drill stem and continue to block said fluid bypass channel until the pressure of the pumped in liquid at the first port decreases below a preselected value above that at the second port and upon decreasing below said preselected value, automatically opening said fluid bypass channel for substantial liquid bypass flow and retaining the fluid bypass channel open even if the liquid pressure at the first port is substantially increased above that of what it was at the time of the automatic opening of the fluid bypass channel, the cooperating means including valving mechanism movable relative to the latch body under liquid pressure from a fluid bypass channel blocking position to at least partially open the fluid bypass channel to permit substantial liquid flow through the second port and then to the first port to allow the assembly to move downwardly in the drill stem at a faster rate than the downward movement of liquid in the drill stem and to block the fluid bypass channel when the assembly seats in the drill stem while liquid is still being pumped in the drill stem.

9. The apparatus of claim 8 wherein the drill stem has a latch seat and support means for supporting the assembly when the assembly is adjacent to the drill bit, further characterized in that a latch is mounted on the latch body for movement between a latch seated position and a latch retracted position, the first and second latch body portions forming an axially inwardly facing annular shoulder seatable on the support means, the first port opening through the outer peripheral surface above the support means and the second port opening through said peripheral surface below the support means when the annular shoulder is seated on the support means.

10. For a wire line core barrel inner tube inner tube assembly, an axially elongated wire line hatch body member having axially inner and outer ends, and a valving assembly, the latch body member having first and second diametric portions, the first diametric portion being axially outwardly of the second diametric portion, of a larger diameter than the second diametric portion, and joined to the second portion to form an axially inwardly facing shoulder, a wall portion forming an axially elongated bore that extends axially inwardly and axially outwardly of the shoulder, a first port opening exteriorly of the latch body axially outwardly of the shoulder and to the bore and a second port opening exteriorly of the latch body axially inwardly of the shoulder and to the bore in axial spaced relationship of the opening of the first port to the bore and axially inwardly thereof, and a valving assembly that includes a ball mounted in the bore and of a diameter for blocking any significant fluid flow through the ports when at least half of the ball is located axially between the openings of the first and second ports to the bore, a piston mounted in the bore for limited axial movement relative to the latch body and the ball, the piston having a reduced diameter portion abuttable against the ball and a second diameter portion joined to the piston reduced portion axially opposite the ball and of a larger diameter than the piston reduced diameter portion, the piston being movable to a first position to retain the ball in the bore so that liquid may readily flow through the bore between the first and second ports, a second position to retain the ball in the bore in a position to retain the ball in the bore in a position to block any significant liquid flow from the first port and through the bore to the second port, but to permit liquid readily flowing through the second port to the bore to move the ball under liquid pressure to permit liquid readily flowing through the bore to the first port and through the first port, and a third position axially intermediate the first and second positions of the piston to retain the ball in the bore in a position to block any significant liquid flow from the first port and through the bore to the second port, but permitting liquid flowing through the second port to the bore to move the ball to permit liquid readily flowing through the bore to the first port and through the first port, and means in the bore for resiliently retaining the piston in the third position while permitting the piston being moved from its third position to its second position under liquid pressure through the first port and bore acting on at least one of the ball and piston to move the piston inwardly and for resiliently moving the piston from its second position to its first position when liquid pressure in the bore decreases below a preselected value, the valving assembly and latch body member having cooperating means for retaining the piston in its third position until liquid pressure in the bore exceeds the preselected value and when the pressure does exceed the preselected value, act on one of the piston and the ball to move the piston to its second position.

11. The apparatus of claim 10 further characterized in that the cooperating means includes means joined to the piston and adapted for movement by a hand tool for moving the piston from its first position to its second position and thence to its third position.

12. The apparatus of claim 11 further characterized in that the cooperating means includes a latch body wall portion defining a chevron shaped slot into which the means adapted for movement extends into said slot for limiting the movement of the piston between the first and second positions and between the second and third positions.

13. The apparatus of claim 11 further characterized in that the piston reduced diameter portion is of an axial length that is greater than the minimum axial spacing between the openings of the first and second ports to the bore.

14. A wire line core barrel inner tube assembly that at least in part is pumpable through a downwardly extending drill stem by liquid under pressure for being seated adjacent to the bit end of the drill stem wherein the drill stem has a latch seat and support means for supporting the assembly when the assembly is adjacent to the drill bit, comprising an axially elongated latch body having a radially outer peripheral surface, a first axially intermediate portion of a larger diameter than any other part of the assembly, a second portion of a smaller diameter than the first portion and axially inwardly of the first portion, and a fluid bypass channel that includes a first port that at least in part opens through the outer peripheral surface axially outwardly of the first portion and a second port that at least in part opens through the outer peripheral surface inwardly of the first portion, the latch body also including an axial bore that forms part of the fluid bypass channel and has the first and second ports opening thereto, a latch mounted on the latch body for movement between a latch seated position and a latch retracted position, the first and second latch body portions forming an axially inwardly facing annular shoulder seatable on the support means, the first port opening through the the outer peripheral surface above the support means and the second port opening through said peripheral surface below the support means when the annular shoulder is seated on the support means, valving means extending within the fluid bypass channel and movable relative to the latch body for permitting bypass liquid flow through the fluid bypass channel and alternately blocking any significant liquid flow through said fluid bypass channel, said latch body and valving means including cooperating means for permitting substantial liquid flow through the fluid channel when liquid is being pumped downwardly in the drill stem to allow the assembly to move downwardly in the drill stem at a faster rate than the downward movement of liquid in the drill stem and to block said fluid bypass channel when said assembly is seated at the bit end of the drill stem and continue to block said fluid bypass channel until the pressure of the pumped in liquid at the first port decreases below a preselected value above that at the second port and upon decreasing below said preselected value, automatically opening said fluid bypass channel for substantial liquid bypass flow and retaining the fluid bypass channel open even if the liquid pressure at the first port is substantially increased above that of what it was at the time of the automatic opening of the fluid bypass channel, the valving means including a piston within the bore and having a lower diametric portion of a diameter to form an axial slidable fit with the latch body wall portion that defines said bore and a reduced portion and having a top end, and a ball located within the bore, movable relative to the piston and abuttable against the piston top end for blocking liquid flow through the bore when at least half of the ball is located axially between the opening of the first port to the bore and the second port to the bore, and resilient means in the bore for resiliently retaining the piston and thereby at least half of the ball above the opening of the first port to the bore after the automatic opening of said channel.

15. The apparatus of claim 14 further characterized in that the cooperating means includes a latch body chevron shaped slot having a vertical leg that has an upper end and a lower end, and an inclined leg having an upper end axially intermediate the upper and lower ends of the vertical leg and a lower end opening to the vertical leg and a valving means guide member fixed to the piston and extending into the chevron slot for movement between a first position adjacent to the vertical leg upper end that the piston is resiliently retained to retain the ball in a position that at least half the ball is above the first port opening to the bore, a second position that the guide member abuts against the inclined leg upper end for having the piston resiliently retained to permit the ball moving to a second position that at least half of the ball is located below the lowermost part of the opening of the first port to the bore, and a third position at the lower end of the vertical leg that the piston is located to permit the ball moving further axially inwardly than when the piston is in its second position, the piston being movable from its its second position to its third position by liquid under pressure acting against at least one of the ball and the piston.

* * * * *

UNITED STATES PATENT AND TRADEMARK OFFICE

CERTIFICATE OF CORRECTION

PATENT NO. : 4,800,969

DATED : Jan. 31, 1989

INVENTOR(S) : Terrence L. Thompson

It is certified that error appears in the above-identified patent and that said Letters Patent is hereby corrected as shown below:

Column 2, line 22, change "part" to --parts--.

Column 7, line 39, change "Z" to --2--.

Column 11, line 62, change "hatch" to --latch--.

Signed and Sealed this

Third Day of October, 1989

*Attest:*

*Attesting Officer*

DONALD J. QUIGG

*Commissioner of Patents and Trademarks*